US009877509B2

(12) United States Patent
Dai et al.

(10) Patent No.: US 9,877,509 B2
(45) Date of Patent: Jan. 30, 2018

(54) MICRO-VAPORIZER HEATING ELEMENT AND METHOD OF VAPORIZATION

(71) Applicant: Westfield Limited (Ltd.), Hong Kong (CN)

(72) Inventors: Wei Dai, Shanghai (CN); Yongjie James Xu, Richmond, VA (US)

(73) Assignee: WESTFIELD LIMITED (LTD.), Hong Kong (CN)

( * ) Notice: Subject to any disclaimer, the term of this patent is extended or adjusted under 35 U.S.C. 154(b) by 638 days.

(21) Appl. No.: 14/230,913

(22) Filed: Mar. 31, 2014

(65) Prior Publication Data

US 2015/0276262 A1 Oct. 1, 2015

(51) Int. Cl.
*A61M 16/00* (2006.01)
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 995,132 A * 6/1911 Griffing ..... F22B 1/287 122/4 A
1,683,760 A * 9/1928 Conners ..... G04B 45/00 392/399
1,960,735 A * 5/1934 Frank ..... B64F 1/18 116/26
2,662,332 A * 12/1953 McIntire ..... A01M 1/2077 392/379
2,850,615 A * 9/1958 Luse, Jr. ..... A63J 5/023 122/41
3,002,237 A * 10/1961 Spexarth ..... A01M 13/00 137/318
3,025,533 A * 3/1962 Hair ..... A61H 33/063 228/234.2
3,245,250 A * 4/1966 Parks, Jr. ..... G01N 1/4022 122/40
3,864,088 A * 2/1975 Delin ..... G01N 33/18 392/399
3,947,659 A * 3/1976 Ono ..... A45D 20/00 34/91
4,078,525 A * 3/1978 Chiba ..... A45D 7/00 122/40
4,114,022 A * 9/1978 Braulke, III ..... A45D 20/08 132/212

(Continued)

OTHER PUBLICATIONS

Vaporizer Learning Center, Vape World, http://www.vapeworld.com/learning-center, 5 pages, downloaded Nov. 8, 2013.

(Continued)

*Primary Examiner* — Thor Campbell
(74) *Attorney, Agent, or Firm* — Nixon & Vanderhye P.C.

(57) ABSTRACT

A heating element for a micro-vaporizer including a heating element, and a wetted surface or a fluid storing membrane that fit snuggly onto an outer surface of the heating element. Vaporization is achieved by applying a current through the heating element that is higher than an inherent power rating of the heating element to generate heat that vaporizes fluids supplied to the wetted surface or stored in the fluid storing membrane.

36 Claims, 5 Drawing Sheets

(56) References Cited

U.S. PATENT DOCUMENTS 4,184,099 A * 1/1980 Lindauer ..... A01M 1/2083 106/243
4,647,433 A * 3/1987 Spector ..... A61L 9/03 206/390
4,722,515 A * 2/1988 Ham ..... B05B 3/082 239/224
4,735,217 A 4/1988 Gerth et al.
4,855,568 A * 8/1989 Wilkins ..... B44C 7/027 392/399
4,922,901 A 5/1990 Brooks et al.
4,954,371 A * 9/1990 Yializis ..... B01D 1/16 392/399
5,371,828 A * 12/1994 Ewing ..... B01D 3/06 122/40
5,553,188 A * 9/1996 Ewing ..... B01D 1/0011 122/40
5,647,052 A * 7/1997 Patel ..... A61L 9/03 392/390
5,711,816 A * 1/1998 Kirlin ..... C23C 16/18 118/726
6,085,026 A * 7/2000 Hammons ..... A61L 9/03 219/544
6,325,475 B1 * 12/2001 Hayes ..... A61B 5/00 128/203.11
6,546,196 B1 * 4/2003 Wu ..... F24F 6/10 392/394
6,965,732 B2 * 11/2005 Golan ..... A47J 27/16 219/505
7,095,953 B2 * 8/2006 Caserta ..... A61L 9/037 392/385
7,149,417 B2 * 12/2006 Joshi ..... A01M 1/2033 392/387
7,263,282 B2 * 8/2007 Meyer ..... A01M 1/2077 392/386
7,845,359 B2 12/2010 Montaser
7,899,309 B2 * 3/2011 Whyatt ..... F23D 11/448 392/307
8,079,371 B2 12/2011 Robinson et al.
8,494,351 B1 * 7/2013 Hayes ..... A61L 9/03 362/122
9,457,117 B2 * 10/2016 O'Leary ..... A61L 9/122
2003/0206730 A1 * 11/2003 Golan ..... A47J 27/16 392/399
2003/0209056 A1 * 11/2003 Dimarzo ..... G01N 25/18 73/25.01
2003/0217750 A1 * 11/2003 Amirpour ..... A61M 11/041 128/203.25
2007/0014549 A1 * 1/2007 Demarest ..... A61M 11/041 392/393
2008/0247736 A1 * 10/2008 Marrs ..... A01M 1/2061 392/387
2014/0205272 A1 * 7/2014 Midgette ..... A61L 9/037 392/395
2015/0313283 A1 * 11/2015 Collett ..... A24F 47/008 131/328
2016/0015847 A1 * 1/2016 Irvin ..... A61L 9/03 392/390

OTHER PUBLICATIONS

Vaporizer Buying Guide, Vape World, http://www.vapeworld.com/vaporizer-buying-guide, 9 pages, downloaded Nov. 8, 2013.

* cited by examiner

MICRO-VAPORIZER HEATING ELEMENT AND METHOD OF VAPORIZATION

TECHNICAL FIELD

The invention disclosed herein relates generally to micro-vaporizers that heat a liquid to generate vapor. The invention particularly relates to resistive heating elements for micro-vaporizers.

BACKGROUND OF THE DISCLOSURE

Micro-vaporizers heat and vaporize small amounts of liquids or soluble solids, such as nicotine containing liquids, fragrances, flavored liquids, chemical agents, biochemical agents, essences, glues, waxes, resins, and saps. Micro-vaporizers typically vaporize fluids at a rate of less than 100 milliliters per hour (ml/h). Micro-vaporizers are applied in products such as: electronic cigarettes, home fragrance dispensers, personal and home dispensers of bug repellent, and medical treatment dispensers for inhalers. Micro-vaporizers are often applied in consumer products used by retail consumers with little or no training or instruction in the use of the product. Micro-vaporizers should be safe for consumer use, easy to operate, reliable, deliver vapor quickly and consistently upon demand by a consumer, require little or no training to operate, be inexpensive to manufacture, and be rugged to withstand shocks from falls and usage by consumer.

A micro-vaporizer has a heating element powered by a battery. The heating element is in contact with the liquid or soluble solid to be vaporized. Conventional heating elements are commonly electric heating coils or Positive Temperature Coefficient (PTC) heating elements. Conventional heating element are commonly immersed in a fluid filled chamber or surrounded by fluid adsorbent material in the micro-vaporizer.

Micro-vaporizers rapidly and repeatedly deliver vapor on demand to a consumer. The consumer may activate heating element by sucking on the end of the micro-vaporizer, pressing a button or otherwise commanding the vaporizer to generate vapor. The need for rapid and repeated generation of vapor has caused conventional heating elements to be configured to consume large amounts of electrical power. To supply the needed power, conventional micro-vaporizers tend to have high charge density batteries, such as lithium batteries and rechargeable batteries. These batteries are relatively expensive, large and unfriendly to the environment when the micro-vaporizer is disposed of. There is a need to avoid expensive and large batteries but still have a micro-vaporizer that rapidly and repeatedly delivers vapor.

SUMMARY OF THE INVENTION

A heating element for a micro-vaporizer has been conceived and is disclosed herein. The heating element is an electrically resistive element having a surface configured to be coated with a thin film of the liquid or solid to be vaporized. The heating element need only heat the thin film to produce vapor. Because only a thin film is being heated, the power consumed by the heating element is relatively small as compared to conventional heating elements that heat a larger volume of the fluid or solid.

The heating element may be adapted from a conventional electrical resistor circuit element. Electrical resistors are well-known, inexpensive and available in a large variety of resistance values. Conventional resistors are passive resistive elements used in electrical circuits. Each resistor has a maximum power rating which indicates the maximum electrical energy that the resistor may dissipate without overheating. Conventional resistors are operated such that the energy applied to the resistor is below the maximum power rating. Conventional wisdom is that operating a resistor above its maximum power rating will create excessive heat and damage the resistor.

In contrast to conventional wisdom and practice, a conventional resistor is operated above its maximum power rating to function as the heating element for a micro-vaporizer. Operating a resistor above its maximum power rating causes the resistor to heat sufficiently to vaporize a thin film of liquid or solid applied to a surface of the resistor. Operating the resistor above its maximum power rating creates an effective and inexpensive heating element for a micro-vaporizer.

Damage that might be caused to the resistor by operating it above its maximum power rating is suppressed by cooling the surface of the resistor with a thin film of a vaporizing fluid or solid and by applying electrical energy to the resistor for short periods, such as while a customer repeatedly inhales on a micro-vaporizer. Further, any damage caused to the resistor may be tolerated if the micro-vaporizer is disposed of after a relatively short period of use, such as less than a day, a week or month.

The embodiments of heating elements for micro-vaporizers disclosed here have benefits including relatively low power consumption, a surface configured to receive and vaporize a thin film of liquid or soluble solid, and may be powered by inexpensive alkaline dry-cell batteries, such as AAA batteries.

The heating elements for micro-vaporizers disclosed herein may be resistors configured to have a wettable surface and to be used in a micro-vaporizer. These types of heating elements can be beneficial by providing a steep temperature gradient that allows for rapid vaporization; being small and compact heating elements, providing a wettable surface to receive a thin film to be vaporized, and being a single-element that is easily mounted in the micro-vaporizer.

An exemplary embodiment of a heating element for a micro-vaporizer comprises a heating element, and a wetted surface on an outer surface of the heating element. Another exemplary embodiment of a heating element for a micro-vaporizer comprises a heating element, and a fluid storing membrane snugly fitted onto an outer surface of the heating element.

An exemplary embodiment of a micro-vaporizer cartridge for vaporization comprises a cartridge casing configured to house the heating element for vaporization that includes a heating element and a wetted surface or a fluid storing membrane snugly fitted onto an outer surface of the heating element.

An exemplary method to vaporize fluids using a heating element comprises steps of applying a fluid onto a wetted surface or a fluid storing membrane that is fitted snugly onto an external surface of a heating element, supplying a current to the heating element that is higher than an inherent power rating of the heating element to generate heat, and vaporizing the fluid on the wetted surface or the fluid storing membrane using the heat generated by the heating element.

DETAILED DESCRIPTION OF THE INVENTION

Figure 1:
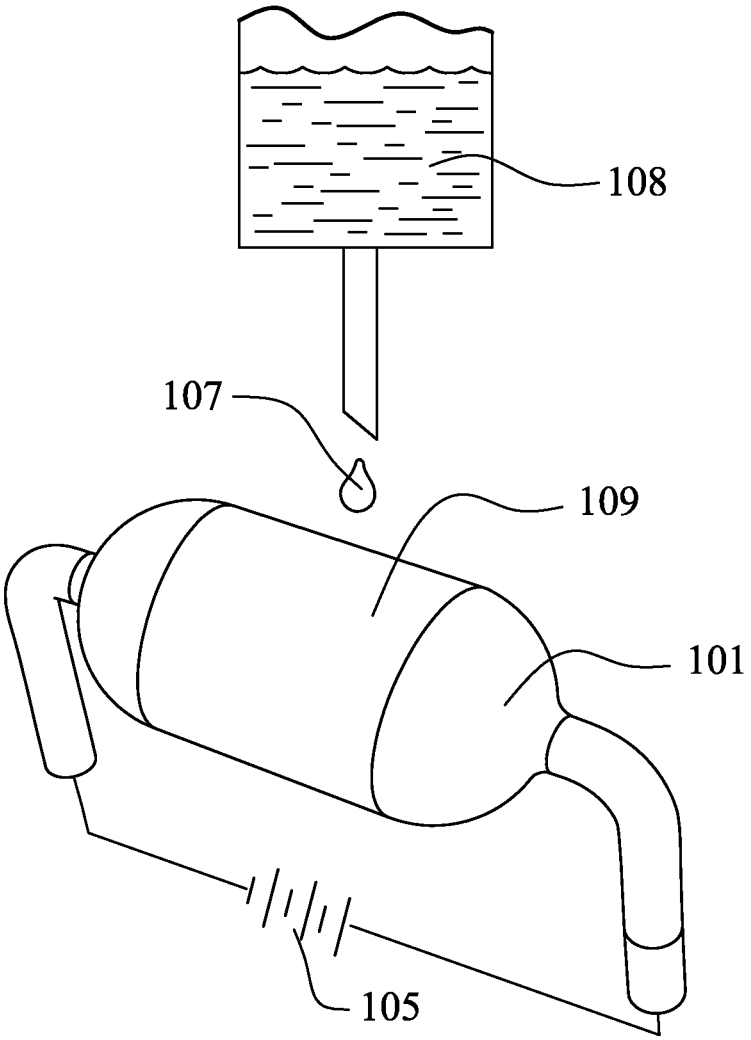
FIG. 1 illustrates a first embodiment of a heating element for a micro-vaporizer.

FIG. 1 illustrates a micro-vaporizer equipped with a single-structured heating element 101, such as a standard resistor with a low power rating. The heating element 101 includes a wettable surface 109 that is adapted to be coated with a thin film of a fluid or soluble solid. The wettable surface may be on the outer surface of the heating element and may have a cylindrical shape.

The wettable surface 109 may be formed of a plastic material commonly used to form the casing for electrical resistors. The wettable surface may have a texture, e.g., smooth, knurled, roughened or with capillary grooves, to promote distribution of a thin film on the surface. The wettable surface may be coated, e.g., painted, with a material that does not mix with the fluid or soluble solid. The wettable surface may hygroscopic to adsorb a liquid. For example, the wettable surface may be formed of polymers such as any or allow of nylon, ABS, polycarbonate, cellulose, poly(methyl methacrylate), polyethylene and polystyrene.

The wetted surface 109 may be wetted by liquid 107 supplied by a liquid applicator 108. The heating element 101 may receive a supply of current that is higher than a maximum power rating of the heating element 101 to cause heating of an outer surface of the heating element. The temperature produced by the heating element 101 may be high enough to damage the heating element 101.

Vaporization occurs by wetting the surface 109 of a resistive heating element 101 and heating the wetted surface. Electricity is applied to the resistive heating element 101 sufficient to heat the wetted surface 109 to a temperature sufficient to vaporize the liquid on the surface. The temperature is achieved as the energy in the electricity is dissipated as heat energy in the resistive heating element.

Conventional resistive elements, such as resistors in electronic circuits, are inexpensive, commercially available in various sizes and resistance values, and easily incorporated into an electrical circuit. However, resistors for electronic circuits are designed to resist current and are not intended to be a heating element. Nevertheless, current passing through a resistor will dissipate electrical energy into the resistor and thereby heat the resistor. The amount of current dissipated as heat into the resistor depends on the structure of the resistor and the current passing through the resistor.

Resistors are not intended to receive current that overheats the resistor. Resistors are typically assigned a Resistor Power Rating that specifies the electrical power in watts that the resistor is designed to safely dissipate. The Resistor Power Rating is an effective maximum power rating for a resistor and depends on the physical size, surface area and material of the resistor. The Resistor Power Rating defines the upper power limit for the resistor. It is conventional practice to operate resistors are power levels below the Resistor Power Rating. It would defy conventional wisdom to operate resistor above the Resistor Power Rating.

Operating a resistor beyond the Resistor Power Rating allows the resistor to serve as a heating element for a micro-vaporizer, especially for a disposable micro-vaporizer. When operated beyond its Resistor Power Rating, the surface of the resistor becomes hot enough to vaporize a liquid or solid applied to the surface.

The power applied to a resistor used as a heating element may be characterized by equation (1) presented below:

$$WX = Wg + Wa \qquad \text{Equation (1)}$$

In Equation (1), Wx is the actual required wattage, Wa is the Resistor Power Rating of the resistor, and Wg is the wattage that exceeds the Resistor Power Rating. The amount of heat generated by the resistor is directly related to the Wg value.

When the temperature of a heating element reaches the maximum working temperature (Tmax), the heating element will become unstable and/or damaged and/or inoperable. With the constant supply of liquid, it may be possible to operate above Tmax of the heating element. Preferably, Tmax may not be reached using the embodiment. Therefore, an embodiment may have a resulting temperature due to the Wg value that is lower than Tmax of the particular heating element used. Because most of the fluids desired to be used in a micro-vaporizer may be vaporized between about 120-230° C., a suitable heating element to be used may preferably have a heat capacity of at least 200° C. A suitable heating element may also be flame retardant, and may not produce any type of smell or gas when operating within both the normal working temperature range and at Tmax.

When an electronic element, such as a resistor, receives a current higher than its power rating, the electronic element rapidly becomes hot. The higher the current supplied beyond the rated capacity, the hotter the electronic element becomes and the element may become unstable and/or damaged and/or inoperable. A micro-vaporizer is disclosed to utilize the heat generated by an electronic element that is given a higher-than-rated-capacity current to vaporize liquids. The liquid applied to the surface of the hot element quickly vaporizes. The vaporization cools the element and thereby prevents heat induced damage to the element.

The power or capacity rating mentioned herein is the basic parameter given by the factory to each electronic element. It is the upper limit of the power capacity that the elements can handle as designed. If used beyond the indicated ratings, the elements might become unstable and/or inoperable and/or damaged.

An exemplary heating element 101 in FIG. 1 is shown in the shape of a rod shaped resistor, however, the heating element may comprise any type of an electronic element, e.g., a resistor, a semiconductor, a MEMS module, or other types of suitable electronic elements. The electronic element may be any type that are heat resistant, uses direct current (DC) power, and the resistance of which can be calculated by using voltage over current. The external electronic element may have an external surface area of less than 5 $mm^2$ (e.g., the external surface of a resistor, and not the surface area of the resistor coil inside the casing).

A conventional rod-shaped resistor, as shown in FIG. 1, may be used as a heating element after it is stripped of the external varnish coating. Other types of resistors, e.g., plate resistors, may also be used. When selecting a suitable heating element, special attention may need to be paid to the conducting anodes and cathodes that connect to the main body of the resistor to ensure heat resistance when strong current is applied. Particularly, attention may need to be specially paid to resistors that include a separate base portion when conducting anodes and cathodes are heated up during the process. Advantages of using a resistor may include the availability to choose from a vast power range of resistors to be compatible to a particular desired power source.

Another exemplary heating element may include using a semiconductor as a heating element. The semiconductor may be used as a heating element by applying a higher-than-capacity current through the positive node on the p-n junction in a semiconductor to generate heat. When designing the semiconductor chip, it may be desirable to use a chip with a series of p-n junctions depending on the desired power source and current, and not to use a current limiting resistor. It may be desirable to limit the liquid resistivity to less than 1 kΩ. Advantages of using a semiconductor as a heating element may include that the surface area, M value, may be less than 0.5 $mm^2$, which may increase the thermal efficiency of the process.

Yet another embodiment for a heating element may be to use an automated MEMS module as a heating element. The heating method and usage may be similar to a semiconductor heating element. Additionally, the automated MEMS module may be able to reduce the time needed to heat up and cool down a heating element by detecting the ambient temperature to increase or decrease current required to heat up and cool down to desired temperatures. An automated MEMS module may have a long usage life because of its ability to control current and temperature automatically.

The heating element may be powered by any type of power source, such as a battery 105 shown in FIG. 1 or a wall outlet (not shown), that may be suitable to apply to the type of heating element used in a desired micro-vaporization product. In an embodiment, a low grade resistor may be used as a heating element in a portable micro-vaporizer, and the micro-vaporizer may be powered by a low grade battery, e.g., an alkaline battery or a zinc-carbon battery. The resistor power rating may be less than the amount of power supplied by the battery to achieve the effect of supplying a higher capacity current through the resistor.

Figure 2:
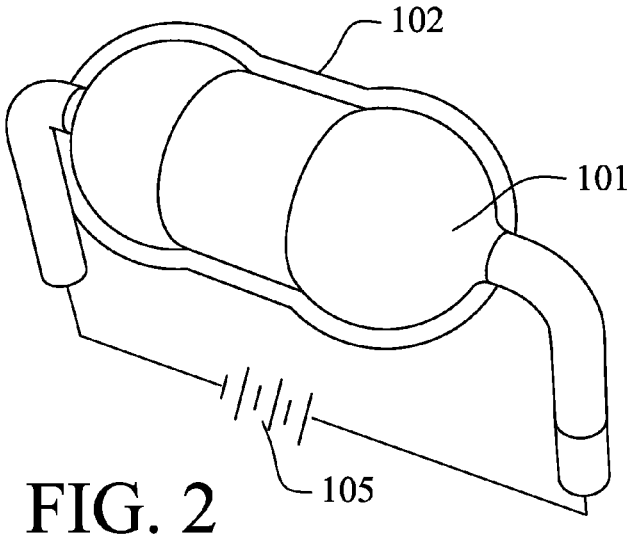
FIG. 2 illustrates a second embodiment of a heating element that includes a membrane.

FIG. 2 shows another exemplary embodiment of a heating element for a microvaporizer that includes a heating element 101 covered by a fluid storing membrane 102. The fluid storing membrane 102 may store fluids to be vaporized using heat generated by the heating element as current goes through the heating element 101. The fluid storing membrane 102 may aid in achieving a constant exchange of temperature gradient between the surface of the heating element 101 and the fluid storing membrane 102 through evaporation of the fluids stored in the membrane 102, thus preventing the heating element 101 from becoming inoperable, and vaporization would be achieved due to evaporation of the fluid from the membrane 102.

An exemplary embodiment of a fluid storing membrane 102 used on a heating element 101 may have a snug fit on the heating element 101 to ensure maximum and uniform surface coverage between the heating element 101 and the fluid storing membrane 102. If a semiconductor is used as a heating element 101, it may be preferable to apply the fluid storing membrane 102 directly and snuggly onto the semiconductor chip, without a semiconductor casing in between the chip and the fluid storing membrane 102.

The fluid storing membrane 102 may be a non-woven or woven material, such as a paper, a cloth, or other absorbent material or coating. The fluid storing membrane 102 may supply a constant flow of fluids onto the surface of the heating element 101 by penetration of fluids through the membrane 102. The fluid storing membrane 102 may possess characteristics to endure at least the maximum temperature to be generated by the heating element 101, preferably at least three times the maximum temperature, to absorb aqueous and oil-based fluids, being flame retardant, and not to emit smells during the vaporization process. However, the membrane 102 may not be immersed in a liquid. Thickness of the fluid storing membrane 102 may be adjusted to modify the amount of vapors to be emitted.

In an embodiment, during the vaporization process, fluids stored in the fluid storing membrane 102 may be vaporized due to a Wg value applied to a heating element, and the membrane 102 may be configured to replenish fluids constantly as the fluids penetrate through the membrane and vaporize. The process may generate desired rate of vaporization by achieving a temperature gradient exchange equilibrium between the heating element 101 and the fluid storing membrane 102 such that the micro-vaporizer works continuously. The Wg and Wa values may achieve a difference of up to about thirty times when an equilibrium in the process is attained. The rate of vaporization may be optimized when the Wg value is close to but not over Tmax value of the heating element.

Required wattage Wx to achieve an equilibrium in the vaporization process may be approximately proportional to the amount of vaporization desired, and they may be calculated using the following equation:

$$Wx \alpha L \alpha M * T * 1/\eta \qquad \text{Equation (2)}$$

where Wx is the required wattage in the process, L is the amount of vaporization, M is the heating element surface area, T is the vaporization temperature, and η is the thermal efficiency that is proportional to the spacing between the fluid to be vaporized and the surface of the heating element 101. Equation 2 represents that Wx is proportional to L and is proportional to the product of M, T and 1/η.

To obtain a desired L value, while maintaining the fluid characteristics, it may be preferable to obtain a decrease in M value while T value increases. Such preference may obtain the advantages of reducing heat transfer loss and acquiring efficient fluid replenishment. For the same reasons, it may also be advantageous to obtain a minimum M value when L value is constant and minimal.

The advantages described may be shown in the exemplary test results below. Table 1 shows the values of M, T and Wx obtained on three types of exemplary heating elements when L=0.1 mg/h.

TABLE 1

| At room temperature - 27° c. | Heating coil | PTC | Resistor (1/16 W) |
|---|---|---|---|
| M ($mm^2$) | 2.5 | 7.2 | 1.5 |
| T (° C.) | 145 | 132 | 182 |
| Wx (W) | 3 | 4.2 | 1.6 |

Table 1 compares differences in required wattage between the conventionally used heating coil and PTC elements, and a 1/16 W resistor as an exemplary heating element 101 used in the embodiments. It can be seen that the resistor requires the least wattage and generates the highest temperature.

FIGS. 3 to 7 illustrate delivery devices for applying liquids, including oils, aqueous solutions, and saps, and soluble solids, such as waxes and resins, may be applied to a heating element for vaporization.

Figure 3:
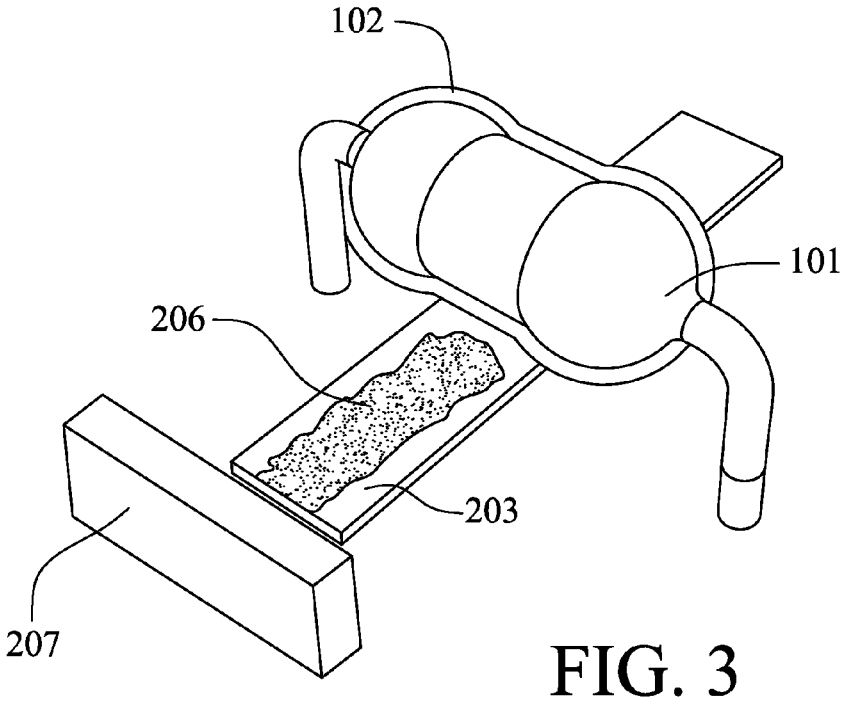
FIG. 3 illustrates a delivery device for a micro-vaporizer that supplies a viscous liquid to a heating element.

FIG. 3 depicts an embodiment that may supply viscous oils onto the fluid storing membrane 102. A liquid guide 203 may be configured to direct the flow of a viscous liquid 206 that may be stored in a liquid source 207, such as a reservoir, onto the membrane 102. The liquid guide 203 may be a wick, a smooth surface, a strip, a plank, or other material that may draw or direct the viscous liquid 206 from the reservoir 207 onto the fluid storing membrane 102.

Figure 4:
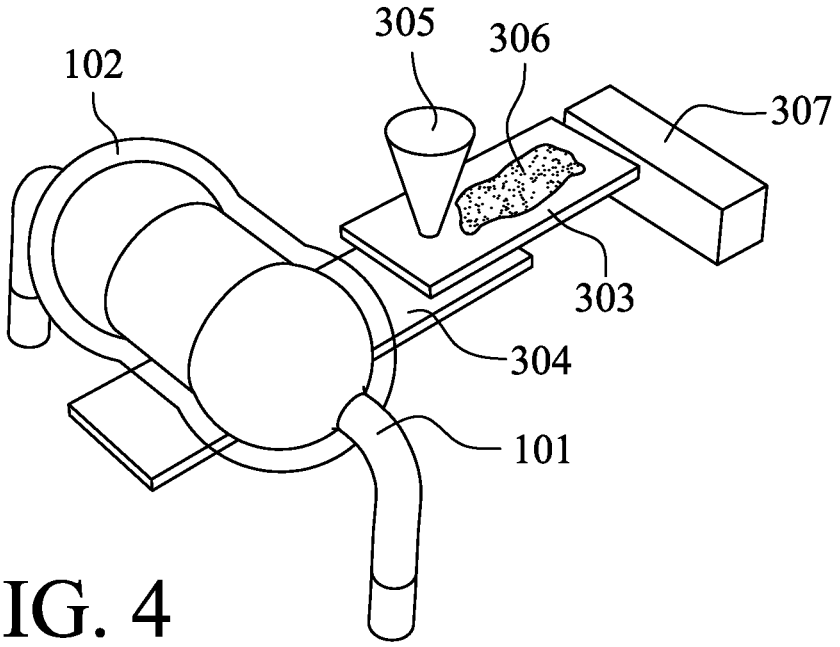
FIG. 4 illustrates a second embodiment a delivery device that supplies oils and aqueous liquids to a heating element.

FIG. 4 depicts an embodiment that may supply less viscous, more liquid-like, oils and aqueous liquids onto a fluid storing membrane 102. A liquid 306 may be introduced to the membrane 102 by activating a switch 305 configured to allow flow of the liquid 306 to be directed from a first liquid guide 303 to a second liquid guide 304 that would then guide the liquid 306 onto the fluid storing membrane 102. The first liquid guide 303 may be directly or indirectly connected to the switch 305 such that after the switch 305 is activated, the first liquid guide 203 may be configured to connect to the second liquid guide 304. The first liquid guide 303 and the second liquid guide 304 may be made of the same or different material, such as a wick, a smooth surface, a strip, a plank, or other material that may draw or direct the liquid 306 from a liquid source 307 to the first liquid guide 303 and the second liquid guide 304, and then onto the fluid storing membrane 102.

Figure 5:
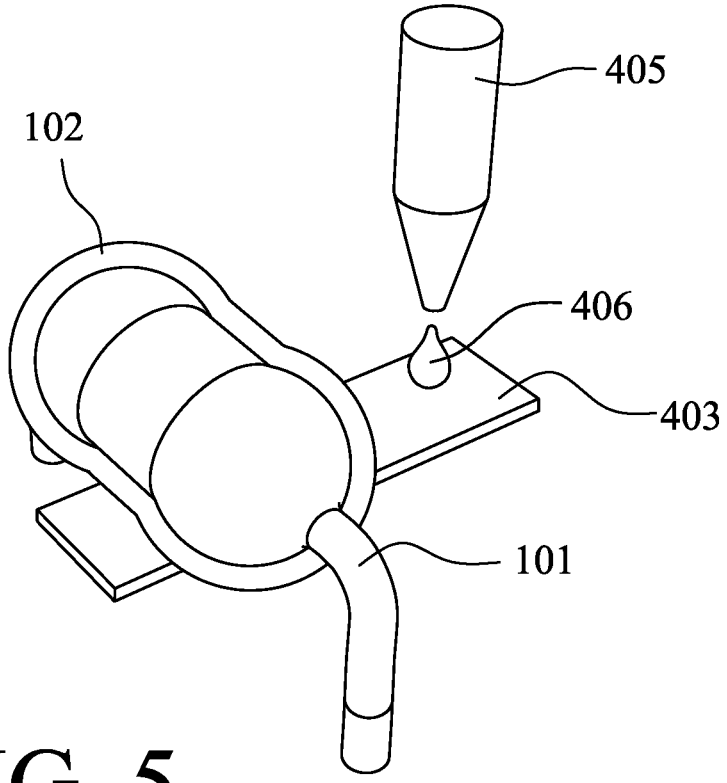
FIG. 5 illustrates a third embodiment a delivery device.

FIG. 5 depicts another embodiment that may supply less viscous, more liquid-like, oils and aqueous liquids onto a fluid storing membrane 102. A liquid 406 may be introduced onto a liquid guide 403 by way of a liquid conduit 405, and the liquid guide 403 then may direct the liquid 406 onto the membrane 102. The liquid conduit 405, such as a dropper, a drip mechanism, a pipette, or a tube, may be configured to draw liquid 406 from a liquid source. The liquid conduit 405 may be made from a glass, a plastic, an organic material such as a reed, or an inorganic material such as a nylon tube, or other material that can channel a fluid. The liquid conduit 405 may also be an opening in a liquid source container that is configured to allow liquid to be drawn onto the fluid guide 403. The liquid guide 403 may be a wick, a smooth surface, a strip, a plank, or other material that may draw or direct the liquid 406 onto the fluid storing membrane 102.

Figure 6:
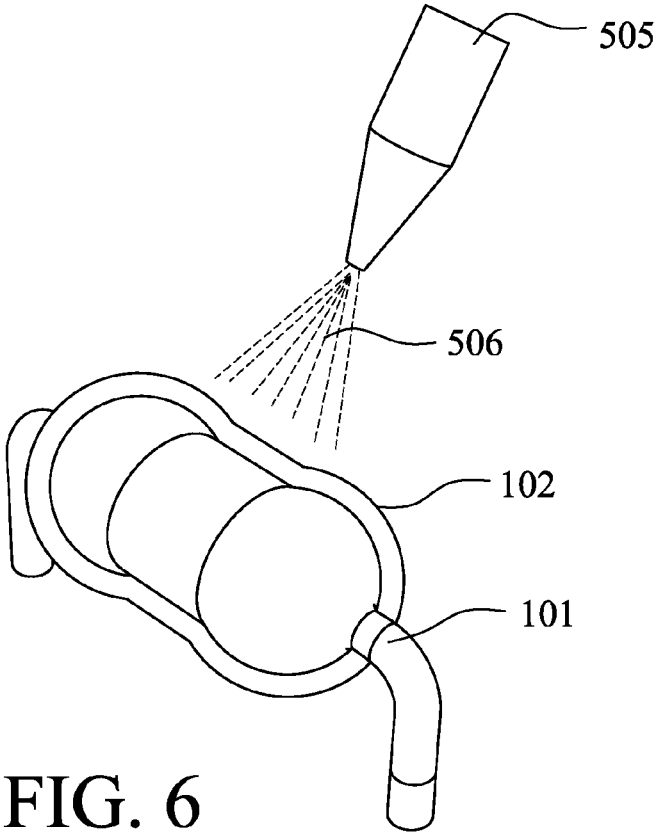
FIG. 6 illustrates a spray type delivery device that supplies fluids to heating elements having semiconductors and an automated Micro-Electro-Mechanical Systems (MEMS) module.

FIG. 6 depicts an embodiment that may supply liquids onto a fluid storing membrane 102 on a semiconductor heating element or an automated MEMS module heating element. A spray 506 may be applied onto the membrane 102 using a fluid spray nozzle 505. The fluid spray nozzle 505 may be a spray nozzle configured to release pressurized or an unpressurized spray material, such as an aerosol spray, that is drawn from a liquid or atomized liquid. The spray 506 may be released from the spray nozzle 505 onto a fluid storing membrane 102.

Figure 7:
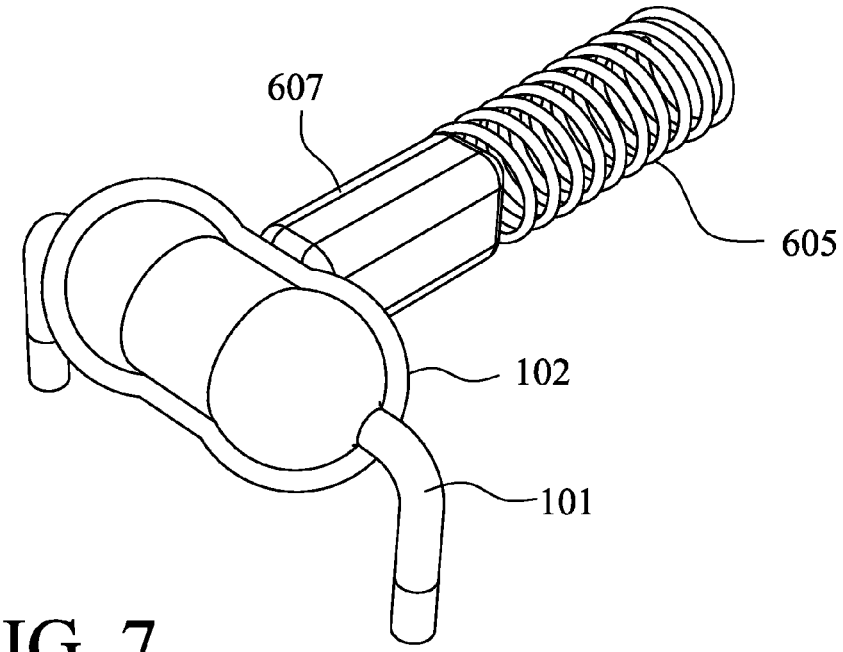
FIG. 7 illustrates a bar type delivery device that supplies soluble solids to a heating element.

FIG. 7 depicts an embodiment that may apply a soluble solid 607 onto a fluid storing membrane 102. The soluble solid 607 may be directed and applied towards the membrane 102 using an applicator 605, such as a spring or other position varying mechanisms. The applicator 605 may be configured to ensure the soluble solid is in constant contact with the heating fluid storing membrane 102 during the vaporization process. A soluble solid 607 may be made of a wax, a resin, or other types of solid material that may be desirable for vaporization. As the heating element 101 heat up when a higher-than-rated-capacity current is applied, the heat may melt the soluble solid 607 and apply the melted soluble solid 607 onto the fluid storing membrane 102 for vaporization. A soluble solid 607 may also be melted into a liquid prior to being applied to the heating element 101 in general.

Figure 8:
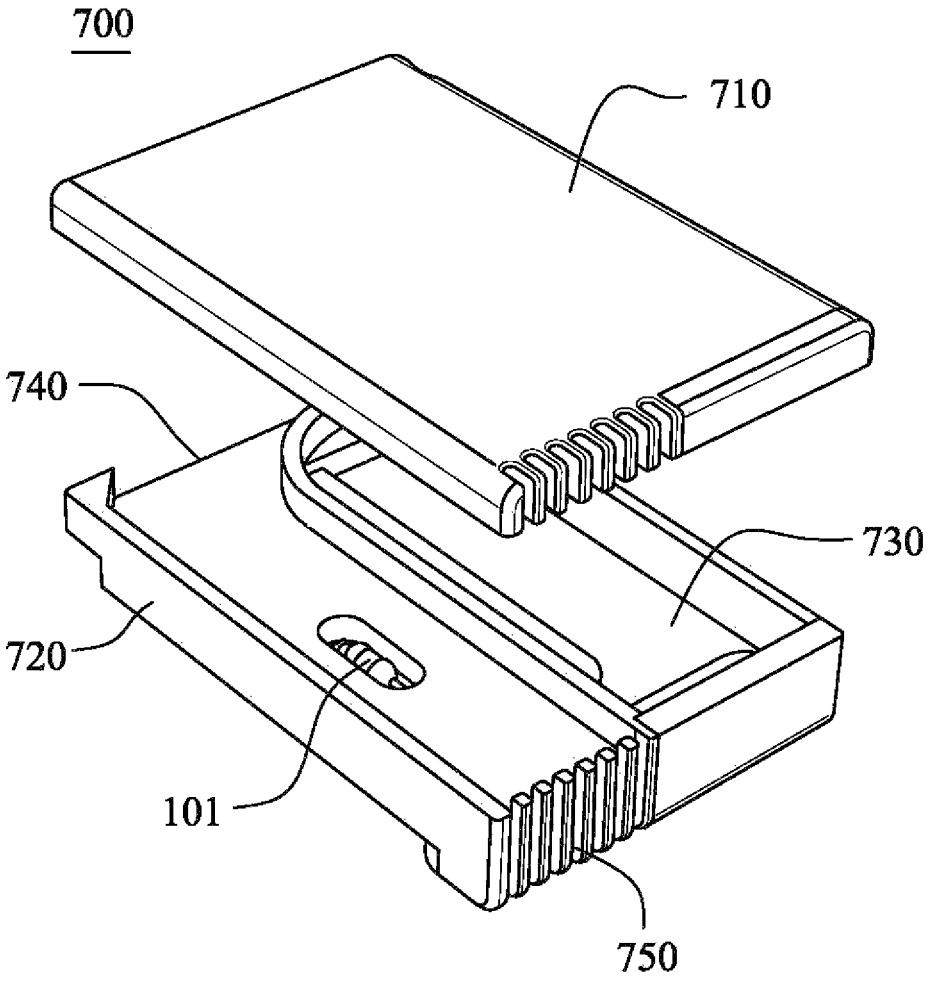
FIG. 8 illustrates a micro-vaporizer cartridge that houses a heating element.

An exemplary cartridge 700 using an exemplary heating element 101 is shown in FIG. 8. A cartridge 700 may comprise a cartridge casing 720 that includes a housing for the heating element 101, a first opening 740 for gas entry, a second opening 750 for vapor to exit the cartridge, and a fluid storage compartment 730 that stores the fluid desired to be vaporized. The cartridge 700 may further comprise a cartridge lid 710 to cover the cartridge casing 720. The cartridge 700 small, light weight, and shaped as a conventional cigarette, shaped to fit in a pocket or pocketbook, or to be attached to a lanyard worn by consumers.

The cartridge 700 may be used as a standalone micro-vaporizer, as a singular and independent cartridge inside a micro-vaporizer product, or in conjunction with other cartridges in a micro-vaporizer product, and be applied to any type of micro-vaporizer products. The cartridge 700 may be configured to encompass different types of liquids desirable for micro-vaporization, including oils, aqueous fluids, and different types of soluble solids, including waxes and resins. The cartridge 700 may be configured to connect to or house a power source to power the heating element 101.

The cartridge 700 may be made of a material that has a heat capacity of at least the maximum temperature to be generated by the heating element 101, preferably at least three times the maximum temperature, the same heat capacity as described for the fluid storing membrane 102. The heating element 101 used in the cartridge 700 may also have a wetted surface. The cartridge 700 may be made into a single structure using a single material, such as from a mold, or be made using different types of materials for the different compartments inside the cartridge 700. In an embodiment, the cartridge 700 may be further enclosed by a heat resistant or insulating material to ensure the heating element 101 does not also heat up the outside of the cartridge 700.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A micro-vaporizer comprising:

an electrically resistive heating element provided in a chamber, the chamber is connected to a vapor outlet;

a wettable surface on an outer surface of the heating element;

a fluid guide abutting the wettable surface, the fluid guide is configured to provide a flow of a liquid onto the wettable surface, the fluid guide is selected from one of a wick, a mesh, a smooth surface, a strip, or a plank; and a portable power source that supplies electrical current to the heating element;

wherein the electrically resistive heating element has a rated capacity for current and is at least one of a resistor, a semiconductor, and a MEMS module; and wherein the electrically resistive heating element receives a higher-than-the rated-capacity current from the power source to produce heat at a temperature in excess of a maximum operation range of the heating element, and the heat is dissipated by the fluid vaporized from the wettable surface such that the heating element is able to operate at the higher-than-rated-capacity current.

2. The micro-vaporizer of claim 1, wherein the heat produced by the heating element is at least at the vaporization point of a fluid applied to the wettable surface of the heating element.

3. The micro-vaporizer of claim 1, wherein the heating element has a heat capacity of at least 200° C.

4. The micro-vaporizer of claim 1, wherein the wettable surface of the heating element has a surface area of less than 5 $mm^2$.

5. The micro-vaporizer of claim 1, wherein the fluid supplied to the wettable surface is one of a viscous fluid, a liquid-like oil, an aqueous liquid, an atomized liquid, or a melted soluble solid.

6. The micro-vaporizer heating element of claim 1, wherein the wettable surface is supplied a constant flow of fluids.

7. The micro-vaporizer of claim 1, wherein the wettable surface may be supplied with a fluid using a fluid spray.

8. The micro-vaporizer of claim 1, wherein the wettable surface is supplied by a soluble solid in a solid form or a melted liquid form.

9. The micro-vaporizer of claim 8, wherein the soluble solid is applied to the wettable surface using an applicator in the form of a spring.

10. The micro-vaporizer of claim 1, wherein the wettable surface has the ability to endure a maximum temperature generated by the heating element.

11. The micro-vaporizer of claim 1, wherein the heating element and the wettable surface is a single structure.

12. A micro-vaporizer comprising:

an electrically resistive heating element provided in a chamber, the chamber is connected to a vapor outlet;

a fluid storing membrane snugly fitted onto an outer surface of the heating element, the fluid storing membrane is configured to allow liquid to be stored in the membrane, and to penetrate through the membrane onto an outer surface of the heating element for vaporization;

a fluid guide abutting the fluid storing membrane, the fluid guide is configured to provide a flow of a liquid onto the fluid storing membrane, the fluid guide is selected from one of a wick, a mesh, a smooth surface, a strip, or a plank; and a portable power source that supplies current to the heating element;

wherein the heating element has a rated capacity for current and comprises at least one of a resistor, a semiconductor, and a MEMS module; and wherein the heating element receives a higher-than-the rated-capacity current from the power source to produce heat at a temperature in excess of a maximum operation range of the heating element, and the heat is dissipated by the liquid vaporized on the outer surface of the heating element such that the heating element is able to operate at the higher-than-rated-capacity current.

13. The micro-vaporizer of claim 12, wherein the fluid storing membrane is a non-woven or woven material.

14. The micro-vaporizer of claim 12, wherein the heating element generates a temperature at least at the vaporization point of a fluid applied to the surface of the heating element from the fluid storing membrane.

15. The micro-vaporizer of claim 12, wherein the heating element has a heat capacity of at least 200° C.

16. The micro-vaporizer of claim 12, wherein the heating element has an external surface area of less than 5 $mm^2$.

17. The micro-vaporizer of claim 12, wherein the heating element is a semiconductor, and the fluid storing membrane is directly fitted to the chip of the semiconductor.

18. The micro-vaporizer of claim 12, wherein the liquid is one of a viscous fluid, a liquid-like oil, an aqueous liquid, an atomized liquid, or a melted soluble solid.

19. The micro-vaporizer of claim 12, wherein the fluid storing membrane supplies a constant flow of fluids onto the surface of the heating element.

20. The micro-vaporizer of claim 12, wherein the fluid storing membrane has the ability to endure at least the maximum temperature to be generated by the heating element.

21. The micro-vaporizer of claim 12, wherein the fluid storing membrane is flame retardant and does not emit smells during the vaporization process.

22. The micro-vaporizer of claim 12, wherein the fluid storing membrane is supplied with a fluid using a fluid spray.

23. The micro-vaporizer of claim 12, wherein the fluid storing membrane is supplied by a soluble solid in a solid form or a melted liquid form.

24. The micro-vaporizer of claim 23, wherein the soluble solid is applied to the fluid storing membrane using an applicator in the form of a spring.

25. A micro-vaporizer cartridge comprising:

a micro-vaporizer configured to produce vapor for repeated inhalation by a user, comprising:

an electrically resistive heating element having a resistive power rating and comprising at least one of a resistor, a semiconductor, and a MEMS module;

a fluid storing membrane snugly fitted onto an outer surface of the heating element, the fluid storing membrane is configured to allow liquid to be stored in the membrane, and to penetrate through the membrane onto an outer surface of the heating element for vaporization;

a fluid guide abutting the fluid storing membrane, the fluid guide is configured to provide a flow of a liquid onto the fluid storing membrane, the fluid guide is selected from one of a wick, a mesh, a smooth surface, a strip, or a plank;

a portable power source that supplies current to the heating element; and a cartridge casing configured to house the heating element, an opening of the cartridge casing is connected to a vapor outlet; and wherein the heating element receives power at a higher level-than the-resistive power rating from the power source to produce heat at a temperature in excess of a maximum operation range of the heating element, and the heat is dissipated by the liquid vaporized on the outer surface of the heating element such that the heating element is able to operate at the higher-than-rated-capacity current.

26. The micro-vaporizer cartridge of claim 25, wherein the fluid storing membrane is a non-woven or woven material.

27. The micro-vaporizer cartridge of claim 26, further comprising a first opening for gas entry and a second opening for vapor to exit the cartridge.

28. The micro-vaporizer cartridge of claim 26, further comprising a liquid storage compartment that stores the liquid desired to be vaporized.

29. The micro-vaporizer cartridge of claim 28, wherein the liquid storage compartment stores one of a viscous liquid, a liquid-like oil, or an aqueous liquid.

30. The micro-vaporizer cartridge of claim 26, wherein the heating element generates heat that is higher than the vaporization point of a fluid applied to the surface of the heating element from the fluid storing membrane.

31. The micro-vaporizer inhaler of claim 26, wherein the heating element has an external surface area of less than 5 $mm^2$.

32. A micro-vaporizer inhaler for vaporization comprising:

a micro-vaporizer comprising:

an electricity resistive heating element having a resistor power rating and comprising at least one of a resistor, a semiconductor, and a MEMS module;

a wettable surface on an outer surface of the heating element;

a fluid guide abutting the wettable surface, the fluid guide is configured to provide a flow of a liquid onto the wettable surface, the fluid guide comprises at least one of a wick, a mesh, a smooth surface, a strip, or a plank; and a portable power source that supplies current to the heating element;

a cartridge casing configured to house the heating element, an opening of the cartridge casing is connected to a vapor outlet; and wherein the heating element receives power at a level higher than the resistor power rating to produce heat at a temperature in excess of a maximum operation range of the heating element, and the heat is dissipated by the fluid vaporized from the wettable surface such that the heating element is able to operate at the higher-than-rated-capacity current.

33. The micro-vaporizer cartridge of claim 32, further comprising a first opening for gas entry and a second opening for vapor to exit the cartridge.

34. The micro-vaporizer cartridge of claim 32, further comprising a liquid storage compartment that stores the liquid desired to be vaporized.

35. The micro-vaporizer cartridge of claim 34, wherein the liquid storage compartment stores one of a viscous liquid, a liquid-like oil, or an aqueous liquid.

36. The micro-vaporizer cartridge of claim 32, wherein the heating element has an external surface area of less than 5 $mm^2$.

* * * * *